US008808012B2

(12) United States Patent
Omae et al.

(10) Patent No.: US 8,808,012 B2
(45) Date of Patent: Aug. 19, 2014

(54) SHIELD CONNECTOR

(75) Inventors: Takashi Omae, Makinohara (JP); Kazuki Zaitsu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 29 days.

(21) Appl. No.: 13/641,259

(22) PCT Filed: Sep. 2, 2011

(86) PCT No.: PCT/JP2011/070540

§ 371 (c)(1), (2), (4) Date: Oct. 15, 2012

(87) PCT Pub. No.: WO2012/029996

PCT Pub. Date: Mar. 8, 2012

(65) Prior Publication Data

US 2013/0084728 A1 Apr. 4, 2013

(30) Foreign Application Priority Data

Sep. 2, 2010 (JP) ..... 2010-196711

(51) Int. Cl.
*H01R 4/66* (2006.01)

(52) U.S. Cl.
USPC ..... 439/98

(58) Field of Classification Search
USPC ..... 439/98, 99, 607.41, 559; 174/652, 78
See application file for complete search history.

(56) References Cited

U.S. PATENT DOCUMENTS 5,691,506 A * 11/1997 Miyazaki et al. ..... 174/652
6,280,208 B1 * 8/2001 Masuda et al. ..... 439/98
6,793,532 B2 * 9/2004 Saito et al. ..... 439/607.41
7,153,146 B2 * 12/2006 Shimizu et al. ..... 439/98
7,368,664 B2 * 5/2008 Asakura et al. ..... 174/78
7,491,071 B2 * 2/2009 Hamai et al. ..... 439/98
8,449,323 B2 * 5/2013 Omae et al. ..... 439/559
8,602,797 B2 * 12/2013 Omae ..... 439/99
2006/0121758 A1 * 6/2006 Asakura et al. ..... 439/98
2012/0190238 A1 * 7/2012 Omae ..... 439/620.01

FOREIGN PATENT DOCUMENTS

JP 2000294344 A 10/2000

OTHER PUBLICATIONS

International Search Report (PCT/ISA/210) dated Nov. 25, 2011 issued by the International Searching Authority in counterpart International Application No. PCT/JP2011/070540.
Written Opinion (PCT/ISA/237) of the International Searching Authority issued Nov. 25, 2011 in counterpart International Application No. PCT/JP2011/070540.

* cited by examiner

*Primary Examiner* — Alexander Gilman
(74) *Attorney, Agent, or Firm* — Sughrue Mion, PLLC

(57) ABSTRACT

A shield connector includes a housing and a shield terminal. The housing, has a tubular shape so that a shield electric wire is inserted thereinto, and is attached to an objective body so as to communicate with an insert hole of the objective body. The shield terminal, has a tubular shape, is electrically conductive, is attached to an inner peripheral side of the housing, and is electrically conducted to the objective body and the shield layer. A seal member having a tubular shape is provided between an inner periphery of the insert hole and the shield electric wire and between the shield terminal and the shield electric wire, so as to seal a part between the inner periphery of the insert hole and an outer periphery of the shield electric wire and a part between an inner periphery of the shield terminal and the outer periphery of the shield electric wire.

4 Claims, 9 Drawing Sheets

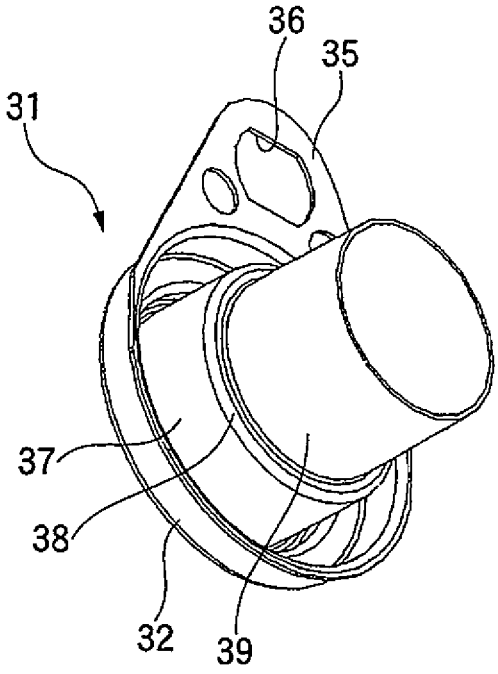
Fig. 3A
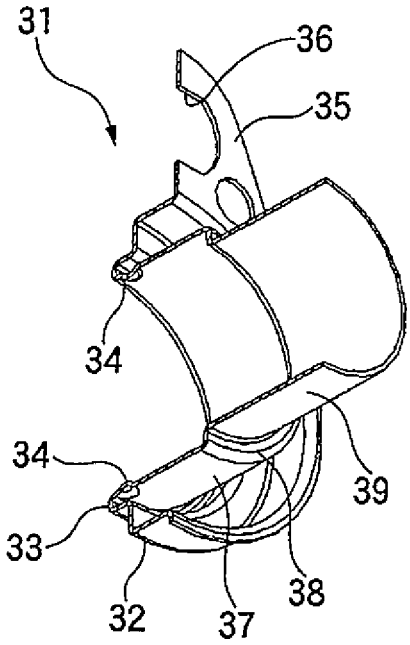
Fig. 3B
Fig. 4
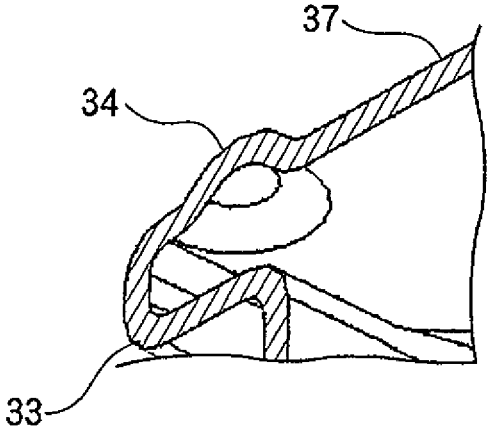

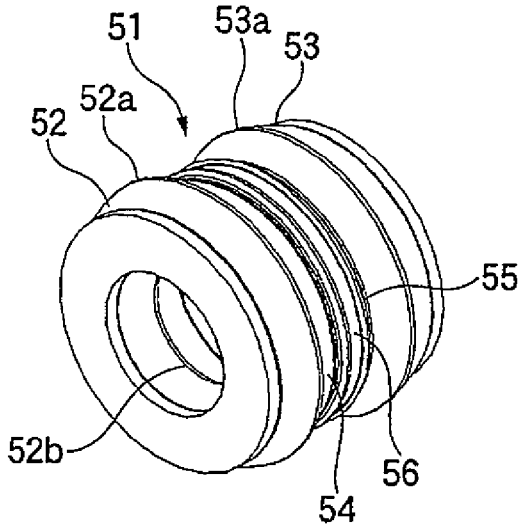
Fig. 5A
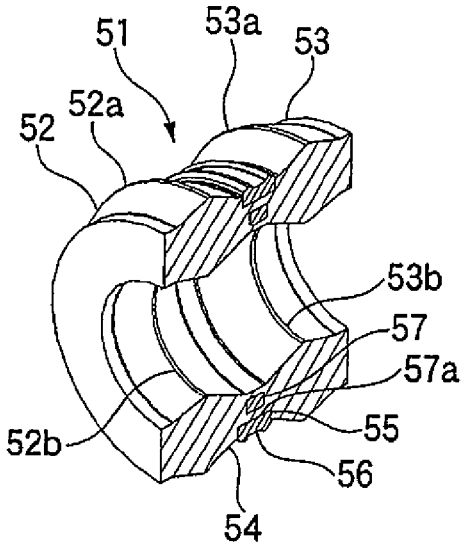
Fig. 5B
Fig. 6
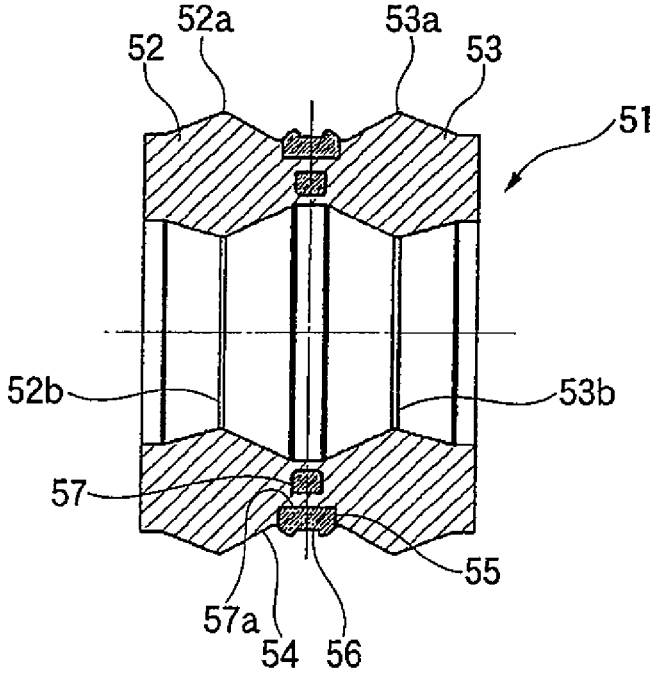

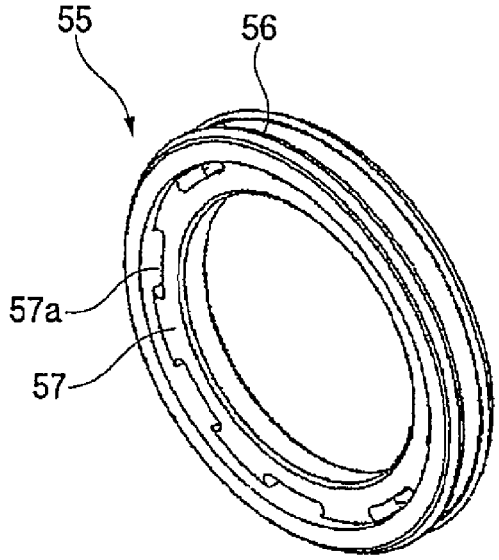
Fig. 7A
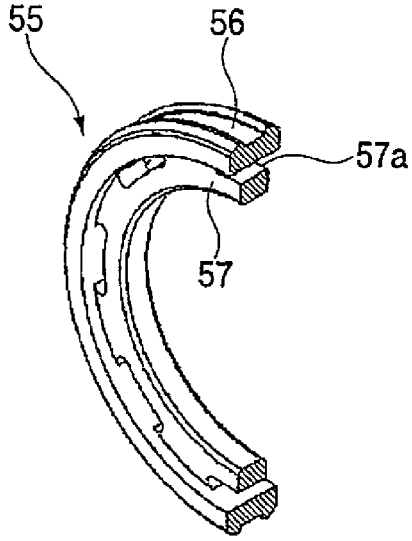
Fig. 7B
Fig. 8
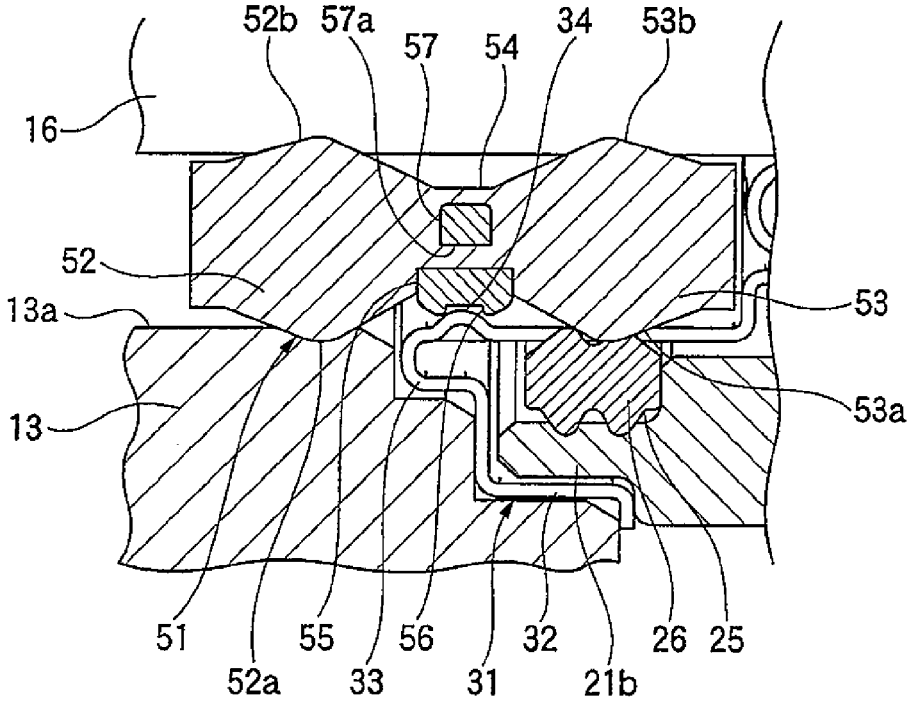

SHIELD CONNECTOR

TECHNICAL FIELD

The present invention is related to a shield connector that connects a shield electric wire to an objective body, and more particularly to a shield connector used for ground connecting the shield electric wire to a body of a motor vehicle.

BACKGROUND ART

For instance, for an electric wire used in a wire harness mounted on a vehicle, a shield electric wire that prevents an influence by an external noise of an electromagnetic wave is used. And the shield electric wire prevents a radiation noise of an electromagnetic wave from leaking to an external part from the electric wire. A core wire of the shield electric wire is shielded by a shield layer such as a braided part. The shield layer is electrically connected to a common ground part in the vehicle, or ground connected to an objective body which is the common ground part itself.

As the shield connector used for connecting the shield electric wire, a conventional shield connector shown in FIG. 13, is known. In the conventional shield connector, a shield electric wire 2 is inserted into a housing 1, a first seal member 3 is attached to the housing 1, then, a shield member 4 is attached to the housing 1, further a second seal member 5 is attached on the shield member 4, a shield layer 6 of the shield electric wire 2 is folded back to the shield member 4, and then, the shield layer 6 and the shield member 4 are crimped by a shield sleeve 7 to have an ground connection (see PTL 1).

Citation List

Patent Literature
[PTL 1] JP-A-2000-294344

SUMMARY OF INVENTION

Technical Problem

Since the conventional shield connector includes the first seal member 3 that seals a part between the shield electric wire 2 and the shield member 4 and the second seal member 5 that seals a part between the shield connector and an attaching hole 10, the number of parts is increased, so that the shield connector is enlarged. Thus, the attaching hole 10 for attaching the shield connector may be possibly enlarged to deteriorate a shield performance.

Further, in the above-described shield connector, since the shield member 4 provided in the folded back part of the shield layer 6 is provided at a position close to a crimping part 8*a* of a terminal 8 connected to core wires 2*a* of the shield electric wire 2, another member such as a cushion ring 9 needs to be provided between the shield member 4 and the crimping part 8*a* of the terminal 8. Thus, the number of parts is more increased to cause a high cost.

In this case, to omit another member such as cushion ring 9, the crimping part 8*a* of the terminal 8 may be supposed to be separated from the shield member 4 to ensure a creeping distance. However, when the crimping part 8*a* is separated from the shield member 4, a device to which the terminal 8 is connected also needs to be separated from an attaching position of the shield connector. Thus, an entire part of the device is caused to be enlarged.

It is therefore one advantageous aspect of the present invention to provide a shield connector which can obtain a high shield performance and a high sealing performance without enlarging the shield connector and increasing a cost.

Solution to Problem

According to one aspect of the invention, there is provided a shield connector, to which a shield electric wire including an inner sheath, a shield layer and an outer sheath provided in this order in a periphery of a core wire is connected, attached to a grounded objective body to guide the shield electric wire to an insert hole formed in the objective body, and electrically conducting current from the shield layer to the objective body, the shield connector comprising:

a housing, having a tubular shape so that the shield electric wire is inserted thereinto, and attached to the objective body so as to communicate with the insert hole of the objective body;

a shield terminal, having a tubular shape, being electrically conductive, attached to an inner peripheral side of the housing, and electrically conducted to the objective body and the shield layer; and a seal member, having a tubular shape, provided between an inner periphery of the insert hole and the shield electric wire and between the shield terminal and the shield electric wire, and configured to seal a part between the inner periphery of the insert hole and an outer periphery of the shield electric wire and a part between an inner periphery of the shield terminal and the outer periphery of the shield electric wire.

The shield connector may be configured such that: an annular member made of a resin is provided integrally in the seal member, and the annular member is engaged with the shield terminal.

The annular member may be provided in an intermediate part of the seal member in an axial direction of the seal member.

The annular member may have a true circle forming part configured to forcibly form an outer form of the inserted shield electric wire to a true circle.

In the shield connector having the structure of the present invention, since the tubular seal member is provided that simultaneously seals the part between the inner periphery of the insert hole of the objective body and the outer periphery of the shield electric wire and the part between the inner periphery of the shield terminal and the outer periphery of the shield electric wire, a cost can be more lowered by the decrease of the number of component parts than a case that seal members for sealing the above-described parts are respectively provided. Further, an inconvenience can be eliminated that the plurality of seal members are used to enlarge the insert hole of the objective body and deteriorate a shield performance.

Further, when a terminal is fixed to the core wire exposed in an end part of the shield electric wire, a separate member made of an insulating material is not provided between the shield terminal and the terminal, nor the shield terminal is greatly separated from the terminal so that an insulation between the shield terminal and the terminal may be ensured by the seal member and the shield performance may be improved. Thus, the increase of the cost due to a provision of the separate parts can be suppressed and an inconvenience can be eliminated that the shield terminal is greatly separated from the terminal to lead to an enlargement.

In the shield connector having the structure of the present invention, since the annular member made of the resin and formed integrally with the seal member is engaged with the shield terminal, the seal member can be held at a prescribed position and a good sealing state by the seal member can be maintained.

In the shield connector having the structure of the present invention, since the annular member which is engaged with the shield terminal is provided in the intermediate part of the seal member in the axial direction, the seal member can be held at the prescribed position with a good balance and the good sealing state can be obtained.

In the shield connector having the structure of the present invention, since the shield electric wire is inserted into the seal member, even when the shield electric wire is somewhat deformed, the outer form of the shield electric wire can be configured to the true circle by the true circle forming part of the annular member. Thus, the seal member can be allowed to come into close contact with the outer periphery of the shield electric wire with a good balance to obtain a good sealing state.

Advantageous Effects of Invention

According to the present invention, the shield connector may be provided which can obtain a high shield performance and a high sealing performance without enlarging the shield connector and increasing the cost.

BRIEF DESCRIPTION OF DRAWINGS

FIG. 3A is a perspective view showing a shield terminal forming the shield connector.

FIG. 3B is a sectional perspective view showing the shield terminal forming the shield connector.

FIG. 4 is a perspective view of the shield terminal forming the shield connector with a part seen in section.

FIG. 5A is a perspective view showing a seal member forming the shield connector.

FIG. 5B is a sectional perspective view showing the seal member forming the shield connector.

FIG. 6 is a sectional view of the seal member forming the shield connector.

FIG. 7A is a perspective view showing an annular member provided in the seal member.

FIG. 7B is a sectional perspective view showing the annular member provided in the seal member.

FIG. 8 is a sectional view of a part of the shield connector showing an engaged state of a recessed part and a protruding part of the shield terminal and the seal member.

FIG. 118 is a sectional perspective view from the inserting side showing the seal member forming the shield connector.

DESCRIPTION OF EMBODIMENTS

Figure 1:
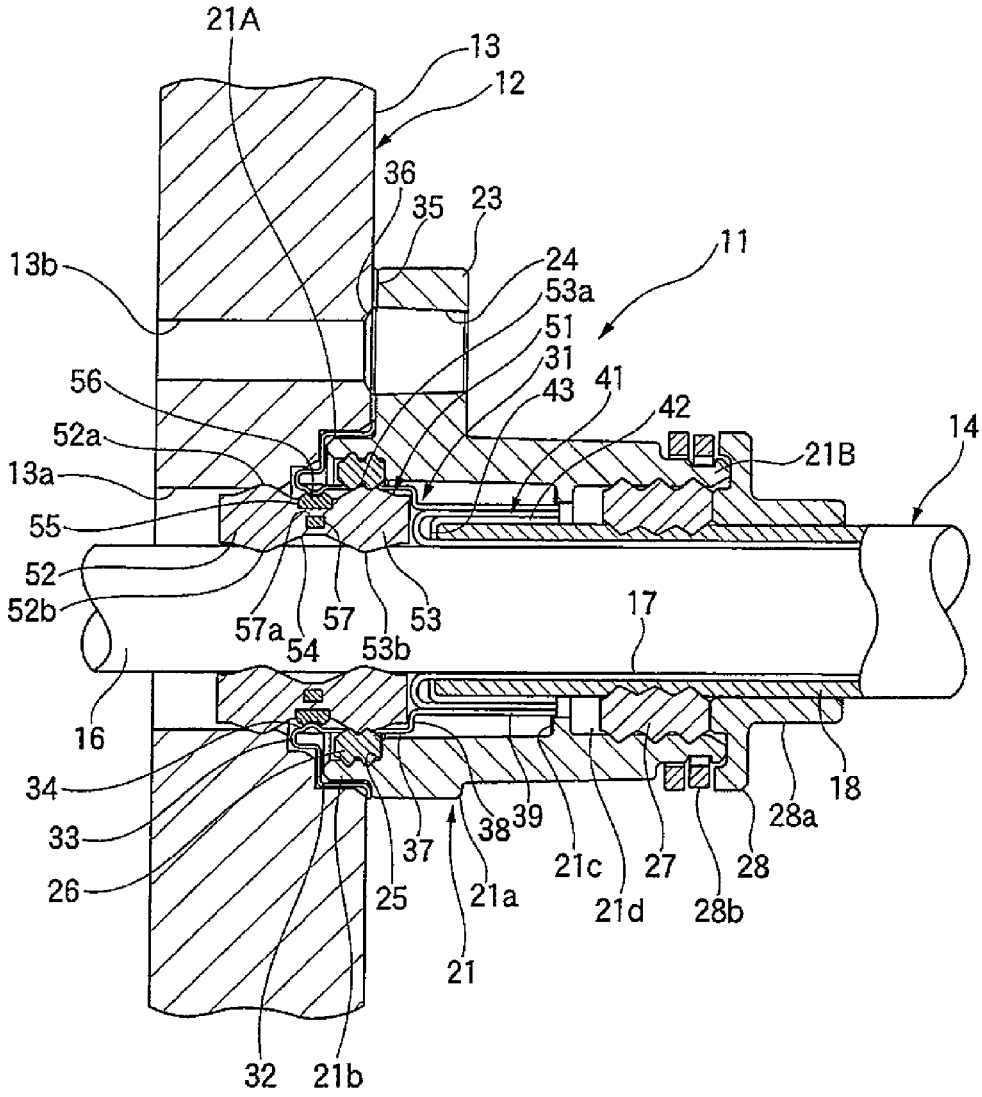
FIG. 1 is a sectional view of a shield connector according to a first embodiment.

Now, embodiments according to the present invention will be described below by referring to the drawings.

Initially, a shield connector according to a first embodiment will be described below.

Figure 2:
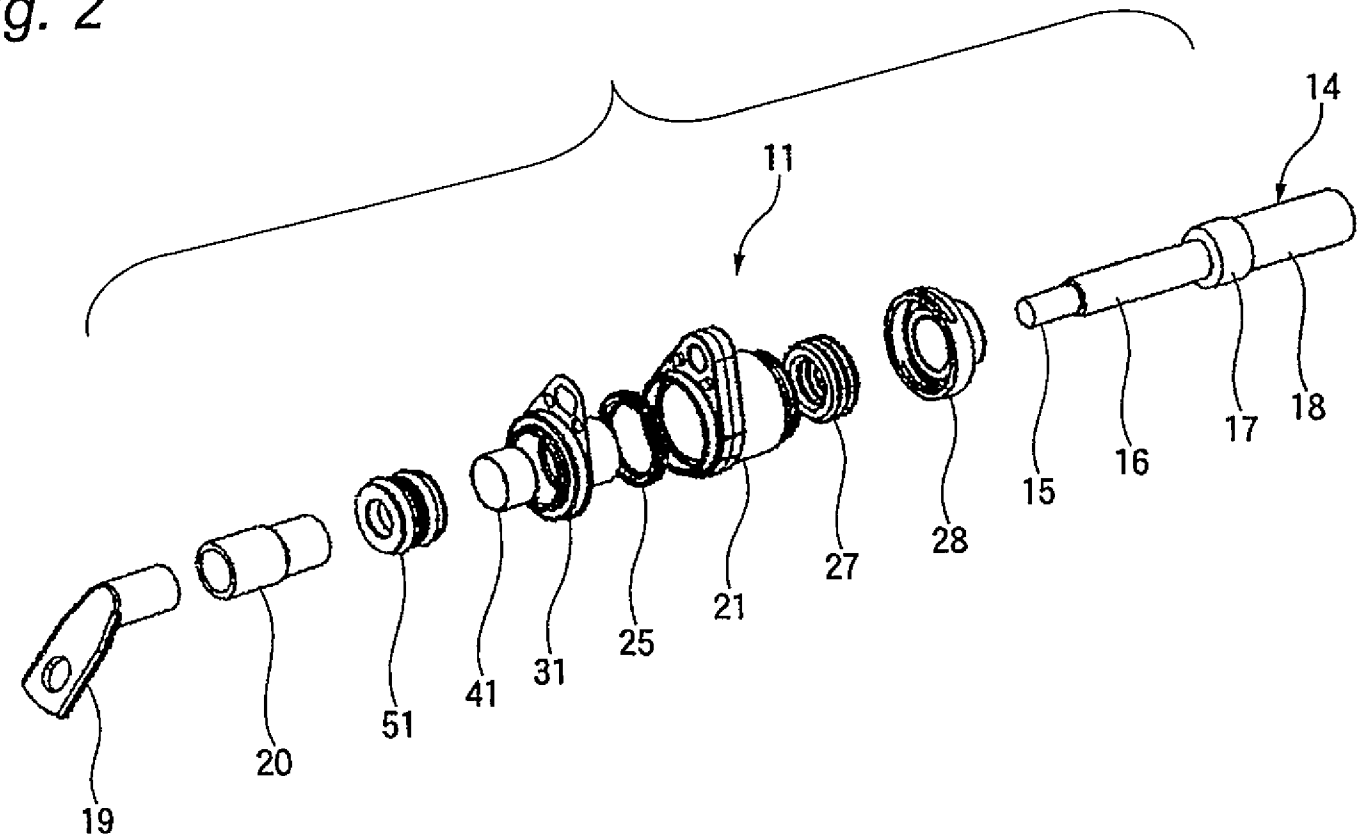
FIG. 2 is an exploded perspective view of the shield connector according to the first embodiment.

FIG. 1 is a sectional view of the shield connector according to the first embodiment. FIG. 2 is an exploded perspective view of the shield connector according to the first embodiment.

As shown in FIGS. 1 and 2, a shield connector 11 is attached to a case (an objective body) 13 of a device 12 such as a motor unit provided in a vehicle such as a motor vehicle to guide a shield electric wire 14 forming a wire harness to the device 12 from an insert hole 13*a* formed in the case 13.

The shield electric wire 14 has a structure that a core wire 15 is coated with an inner sheath 16 as an insulating material, the inner sheath 16 is coated with a shield layer 17 as a braided part which is a mesh shaped electrically conductive material, and the shield layer 17 is coated with a sheath which is an outer sheath 18 as an insulating material. Then, in the shield electric wire 14, a part of the outer sheath 18 is cut by a cutter in the vicinity of the shield connector 11 to expose the shield layer 17, and further, the shield layer 17 is cut by the cutter so that the shied layer 17 has a prescribed length. Thus, the inner sheath 16 is exposed. Then, in the shield electric wire 14, a crimping terminal 19 is crimped and connected to the core wire 15 exposed from the inner sheath 16, and a crimped part thereof is coated with a thermally shrinking tube 20.

The shield connector 11 includes a housing 21. The housing 21 is made of an insulating material such as a synthetic resin and formed in a cylindrical shape. The shield electric wire 14 is inserted into the housing 21. The housing 21 has one end side set as an attaching side 21A and the other end side set as a cable inserting side 21B. In the housing 21, the attaching side 21A is attached to the case 13 of the device 2 and the shield electric wire 14 is inserted from the cable inserting side 21B.

In the vicinity of the attaching side 21A of the housing 21, a flange part 21*a* is formed that protrudes to an outer periphery side and a strength is increased. The attaching side 21A from the flange part 21*a* is formed as an annular protruding part 21*b*. The flange part 21*a* has a mountain shaped attaching piece 23 in a part and an attaching hole 24 is formed substantially at a central part of the attaching piece 23. Into the attaching hole 24, a fastening tool such as a bolt can be inserted. The bolt is inserted into the attaching hole 24 and screwed to a tapped hole 13*b* formed in the case 13 of the device 2, so that the housing 21 is fastened and fixed to the case 13 together with a fixing piece 35 of a below-described shield terminal 31.

In the annular protruding part 21*b* of the attaching side 21A of the housing 21, a stepped part 25 is formed in an inner periphery side. An inner seal 26 formed in an annular shape is fitted to the stepped part 25. A part between the housing 21 and the below described shield terminal 31 is sealed by the inner seal 26.

Further, in the housing 21, an annular rib 21 is formed which protrudes over a circumferential direction in an inner periphery in an intermediate part of the axial direction. The cable inserting side 21B from the annular rib 21*c* in the inner peripheral side of the housing 21 is formed as a seal accommodating part 21*d*.

Then, to the seal accommodating part 21*d*, a wire seal 27 is fitted. A part between the shield electric wire 14 and the housing 21 is sealed by the wire seal 27 in the cable inserting side 21B of the housing 21.

To the cable inserting side 21B of the housing 21, a rubber stopper 28 is attached. The rubber stopper 28 includes a tubular stopper main body 28*a* into which the shield electric wire 14 is inserted and a cover part 28*b* provided integrally in an outer peripheral side of the stopper main body 28*a* and covering the cable inserting side 21B of the housing 21. Then, the inserting side 21B as a rear end of the housing 21 is further sealed by the rubber stopper 28 and the wire seal 27 is prevented from slipping out.

To the attaching side 21A of the housing 21, the shield terminal 31 is attached. The shield terminal 31 is formed by press working an electrically conductive metal plate. As shown in FIGS. 3A and 3B, the shield terminal 31 includes a ring shaped protruding part 32 bent so as to cover the annular protruding part 21*b* and the inner seal 26 in the attaching side 21A from the flange part 21*a*.

Further, the ring shaped protruding part 32 of the shield terminal 31 has an inner peripheral side formed as an annular engaging protrusion 33 protruding to the case 13 side. As shown in FIG. 4, in the annular engaging protrusion 33, two engaging protrusions 34 protruding to a central side are formed at opposed positions in an inner peripheral surface thereof.

In the ring shaped protruding part 32 of the shield terminal 31, a mountain shaped fixing piece 35 is formed on a part of an outer periphery thereof. The fixing piece 35 is formed substantially in the same outer shape as that of the attaching piece 23 of the housing 21. In the fixing piece 35, an attaching hole 36 is formed that has substantially the same form and the same size as the form and the size of the attaching hole 24 provided in the attaching piece 23. Then, the attaching piece 23 of the housing 21 is overlapped on the fixing piece 35 of the shield terminal 31, a bolt or a screw made of metal is inserted through the attaching holes 24 and 36 which communicate with each other and fastened to the tapped hole 13*b* of the case 13. Thus, the fixing piece 35 of the shield terminal 31 is fixed to the case 13 of the device 12 together with the attaching piece 23 of the housing 21. Thus, the shield terminal 31 is electrically conducted to the case 13 of the device 12.

Further, the shield terminal 31 includes, in an inner peripheral edge of the ring shaped protruding part 32, a tubular part 37 continuous in parallel with a central line of the housing 21 and a tubular crimping part 39 continuous to the tubular part 37 in parallel with the central line of the housing 21 through a stepped part 38 and having a diameter smaller than that of the tubular part 37.

An end part of the tubular crimping part 39 is opened. When the shield terminal 31 is attached to the housing 21, the end part of the crimping part 39 is located in the vicinity of the annular rib 21*c*.

In the shield terminal 31, a shield sleeve 41 is provided in an inner peripheral side thereof. The shield sleeve 41 is made of an electrically conductive metal tubular body and formed by a pressing work. An inside diameter of the shield sleeve 41 is substantially equal to an outside diameter of the outer sheath 18 of the shield electric wire 14. Accordingly, the inside diameter of the shield sleeve has a size that comes close contact with a dimension of the outside diameter of the shield electric wire 14 inserted into the housing 21, that is, an outer periphery of the outer sheath 18. The shield sleeve 41 includes a tubular part 42 having the same diameter over an entire length and a diameter reduced piece 43 bent substantially at right angles to a center of the shield sleeve 41 in an end of the tubular part 42. In the diameter reduced piece 43, an outer surface of a corner part continuous to the tubular part 42 forms a smooth circular arc surface.

Then, the tubular part 42 of the shield sleeve 41 is inserted to the outer periphery of the outer sheath 18 so that the diameter reduced piece 43 of the shield sleeve 41 is engaged with a cut end of the outer sheath 18 of the shield electric wire 14. On the other hand, on the tubular part 42 of the shield sleeve 41 covering the outer sheath 18, the shield layer 17 of the prescribed length which is cut by the cutter and left is folded back so as to cover the diameter reduced piece 43 from an outer part.

The shield layer 17 folded back on the tubular part 42 is inserted into the crimping part 39 of the shield terminal 31. The crimping part 39 applies a crimping force from an outer periphery of the crimping part 39, so that the crimping part 39 integrally holds the shield electric wire 14 including the outer sheath 18, the shield layer 17, the inner sheath 16 and the core wire 15 in the housing 12 through the shield layer 17 and the shield sleeve 41.

In the case 13 side of the shield terminal 31, a seal member 51 formed in a tubular shape is provided. The seal member 51 is formed with, for instance, an elastic material such as rubber. As shown in FIGS. 5A and 5B and FIG. 6, the seal member 51 has two annular seal parts 52 and 53 whose thickness is large. The seal part 52 has lip parts 52*a* and 52*b* which gradually protrude to an outer peripheral side and an inner peripheral side. The seal part 53 also has lip parts 53*a* and 53*b* which gradually protrude to an outer peripheral side and an inner peripheral side similarly to the seal part 52.

The seal member 51 has a part between the seal parts 52 and 53 as an intermediate part in the axial direction formed as a compressed part 54 whose thickness is reduced. In the intermediate part of the seal member 51 formed as the compressed part 54, an annular member 55 is integrally provided. The seal member 51 is symmetrically formed with respect to the intermediate part in the axial direction as a boundary where the annular member 55 is provided.

The annular member 55 is formed with a synthetic resin such as plastic. As shown in FIGS. 7A and 7B, in an outer peripheral side of the annular member 55, an engaging groove 56 is formed in the circumferential direction. Further, in an inner peripheral surface side of the annular member 55, a rib 57 is formed in the circumferential direction. In the rib 57, a plurality of hole parts 57*a* are formed at prescribed intervals in the circumferential direction. The rubber that forms the seal member 51 enters the hole parts 57*a*. Thus, the annular member 55 is strongly embedded in the rubber that forms the seal member 51. Further, in the annular member 55, the outer peripheral part having the engaging groove 56 is not embedded in the seal member 51 and exposed.

In the seal member 51, the seal part 52 is arranged between the insert hole 13*a* of the case 13 and the inner sheath 16 of the shield electric wire 14, the lip part 52*a* of the seal part 52 is allowed to come into close contact with an inner peripheral surface of the insert hole 13*a* and the lip part 52*b* of the seal part 52 is allowed to come into close contact with an outer peripheral surface of the inner sheath 16. Thus, a part between the insert hole 13*a* of the case 13 and the inner sheath 16 of the shield electric wire 14 is sealed by the seal part 52 of the seal member 51.

Further, in the seal member 51, the seal part 53 is arranged between the tubular part 37 of the shield terminal 31 and the inner sheath 16 of the shield electric wire 14, the lip part 53*a* of the seal part 53 is allowed to come into close contact with an inner peripheral surface of the tubular part 37 and the lip part 53*b* of the seal part 53 is allowed to come into close contact with an outer peripheral surface of the inner sheath 16. Thus, a part between the tubular part 37 of the shield terminal 31 and the inner sheath 16 of the shield electric wire 14 is sealed by the seal part 53 of the seal member 51.

In such a way, the seal member 51 has a function that simultaneously seals the part between the inner periphery of the insert hole 13*a* and the outer periphery of the inner sheath 16 of the shield electric wire 14 and the part between the inner periphery of the tubular part 37 of the shield terminal 31 and the outer periphery of the inner sheath 16 of the shield electric wire 14.

Further, as shown in FIG. 8, the engaging protrusions 34 formed in the annular engaging protrusion 33 of the shield terminal 31 are respectively engaged, in an engagement of recessed and protruding parts, with the engaging groove 56 of the annular member 55 provided in the compressed part 54 of the seal member 51. Thus, a movement of the seal member 51 in the axial direction is regulated.

As described above, according to the shield connector of the first embodiment, since the tubular seal member 51 is provided that simultaneously seals the part between the inner periphery of the insert hole 13*a* of the case 13 and the outer periphery of the inner sheath 16 forming the shield electric wire 14 and the part between the inner periphery of the shield terminal 31 and the outer periphery of the inner sheath 16 of the shield electric wire 14, a cost can be more lowered by the decrease of the number of component parts than a case that seal members for sealing the above-described parts are respectively provided. Further, an inconvenience can be eliminated that the plurality of seal members are used to enlarge the insert hole 13*a* of the case 13 and deteriorate a shield performance.

Further, when the crimping terminal 19 is fixed to the core wire 15 exposed in an end part of the shield electric wire 14, a separate member made of an insulating material is not provided between the shield terminal 31 and the crimping terminal 19, nor the shield terminal 31 is greatly separated from the crimping terminal 19 so that an insulation between the shield terminal 31 and the crimping terminal 19 may be ensured by the seal member 51 and the shield performance may be improved. Thus, the increase of the cost due to a provision of the separate parts can be suppressed and an inconvenience can be eliminated that the shield terminal 31 is greatly separated from the crimping terminal 19 to lead to an enlargement.

Further, since the annular member 55 made of the resin and formed integrally with the seal member 51 is engaged, in the engagement of the recessed and protruding parts, with the shield terminal 31, the seal member 51 can be held at a prescribed position and a good sealing state by the seal member 51 can be maintained.

Further, since the annular member 55 which is engaged, in the engagement of the recessed and protruding parts, with the shield terminal 31 is provided in the intermediate part of the seal member 51 in the axial direction, the seal member 51 can be held at the prescribed position with a good balance and the good sealing state can be obtained.

Especially, since the seal member 51 is symmetrically formed with respect to the intermediate part in the axial direction as a boundary where the annular member 55 is provided, directional characteristics of the seal member 51 can be eliminated and an attaching operation can be easily carried out.

Further, since the intermediate part of the seal member 51 is compressed, when the inner sheath 16 of the shield electric wire 14 is inserted to the seal member 51, the seal parts 52 and 53 of the seal member 51 are easily deformed. Accordingly, an inserting operation of the inner sheath 16 of the shield electric wire 14 can be easily achieved.

Further, since the seal member 51 is provided with the annular member 55 made of the resin, when the seal member 51 is attached to the shield terminal 31, the annular member 55 harder than other parts can be gripped and pushed in to fit the seal member to the shield terminal 31.

Now, a shield connector according to a second embodiment will be described below.

The same components as those of the first embodiment are designated by the same reference numerals and a description thereof will be omitted.

Figure 9:
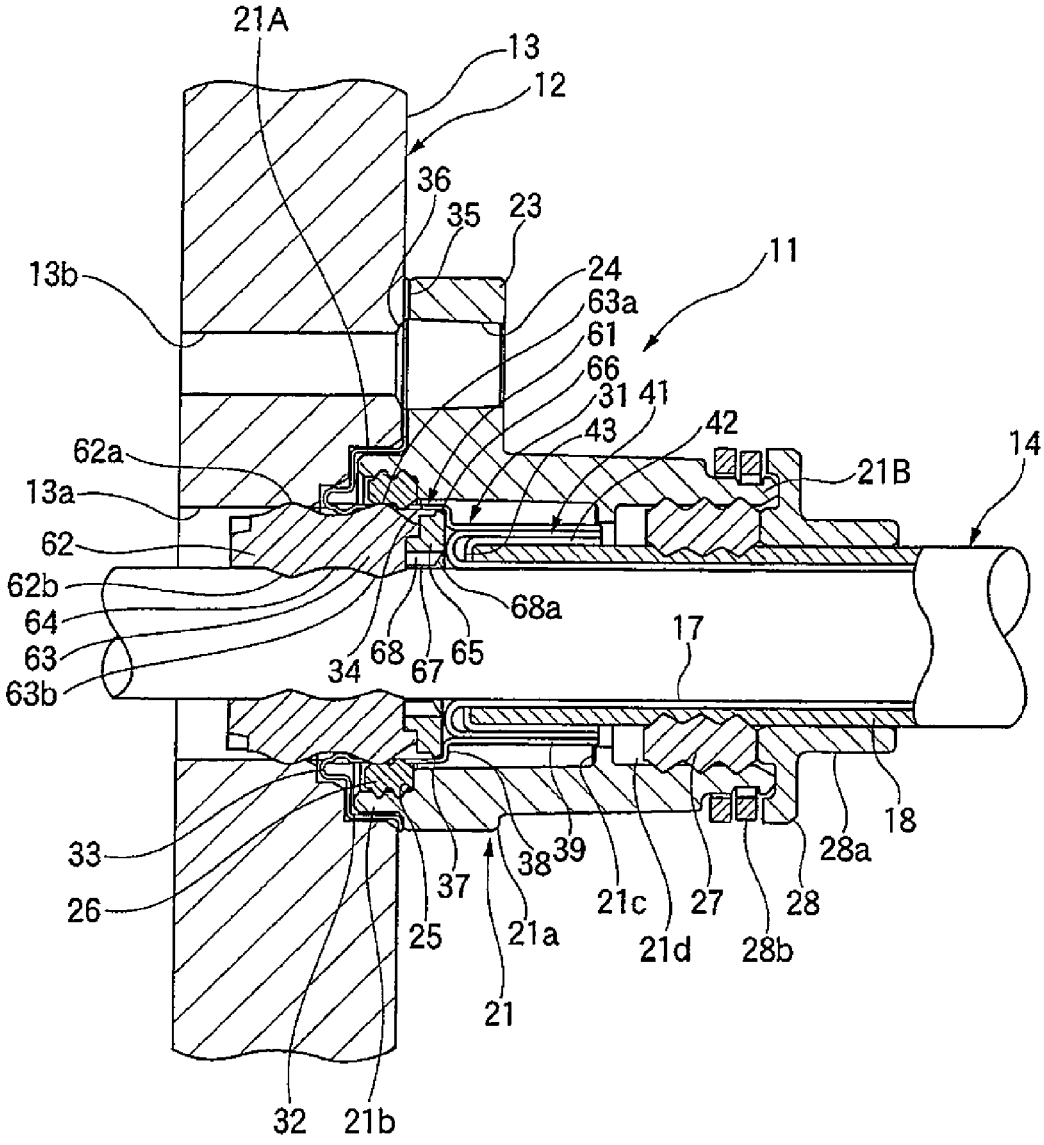
FIG. 9 is a sectional view of a shield connector according to a second embodiment.
Figure 10:
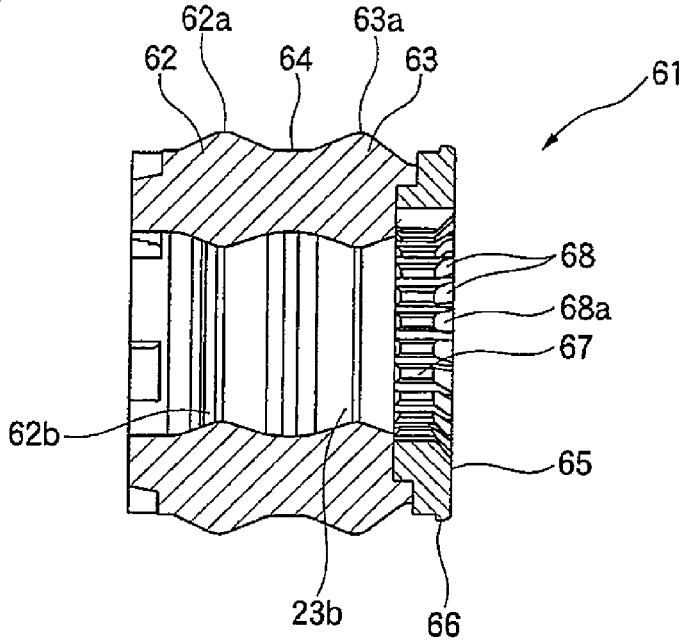
FIG. 10 is a sectional view of a seal member forming the shield connector.
Figure 11A:
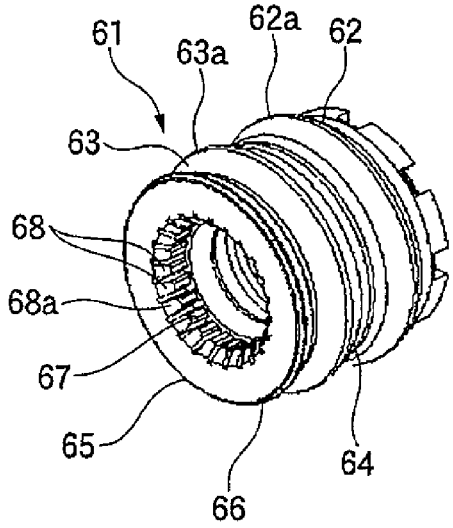
FIG. 11A is a perspective view from an inserting side showing the seal member forming the shield connector.
Figure 11B:
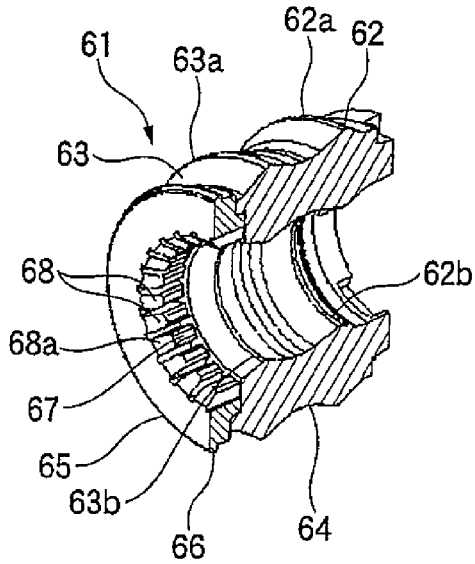
Figure 12A:
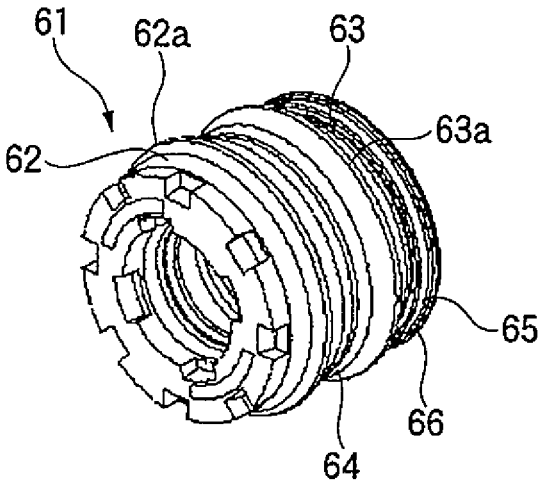
FIG. 12A is a perspective view from an attaching side showing the seal member forming the shield connector.
Figure 12B:
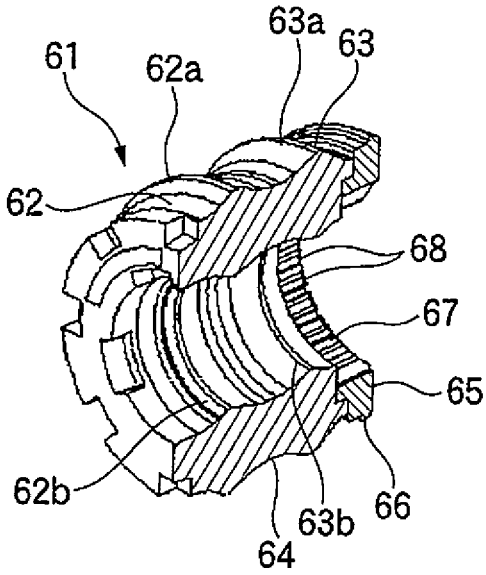
FIG. 12B is a perspective view seen in section from the attaching side showing the seal member forming the shield connector.
Figure 13:
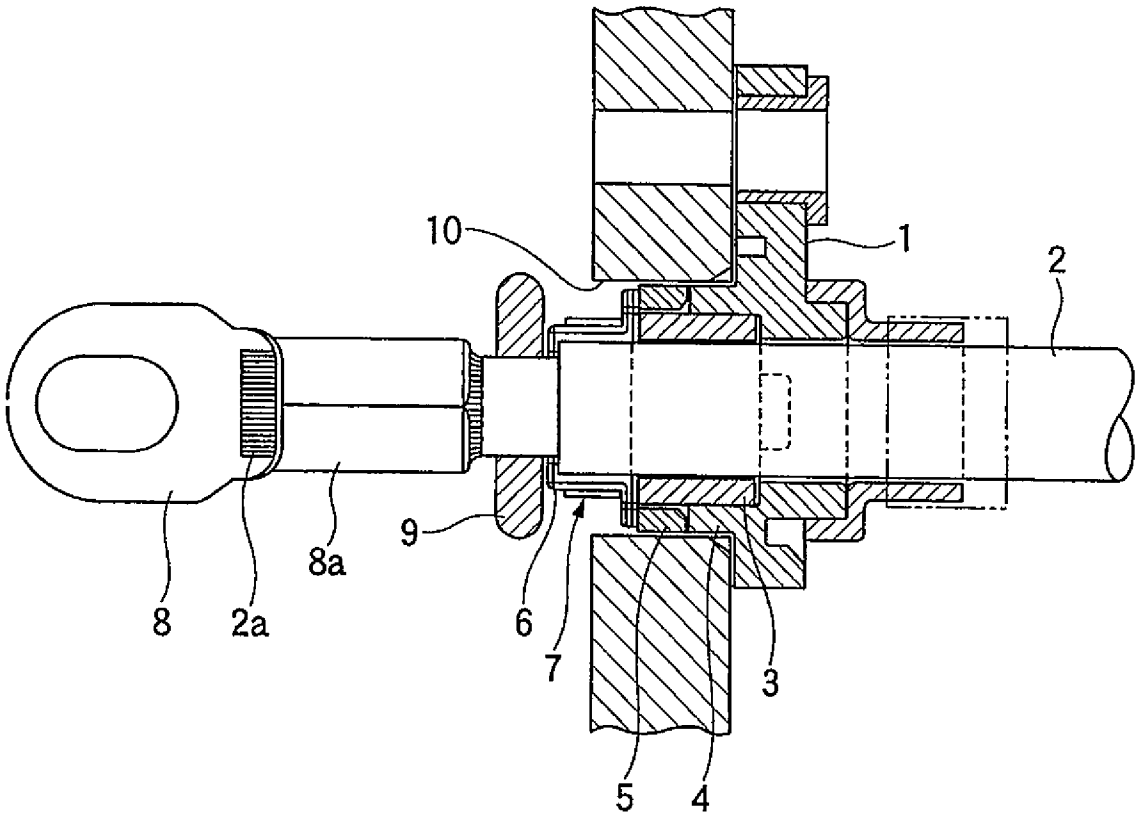
FIG. 13 is a sectional view for explaining a usual example of a shield connector.

As shown in FIGS. 9 and 10, in a shield connector 11, a seal member 61 different from the first embodiment is provided.

The seal member 61 is also formed with, for instance, an elastic material such as rubber. As shown in FIGS. 11A, 11B, 12A and 12B, the seal member has two annular seal parts 62 and 63 whose thickness is large. The seal part 62 has lip parts 62*a* and 62*b* which gradually protrude to an outer peripheral side and an inner peripheral side. The seal part 63 also has lip parts 63*a* and 63*b* which gradually protrude to an outer peripheral side and an inner peripheral side similarly to the seal part 62.

The seal member 61 has a part between the seal parts 62 and 63 as an intermediate part in the axial direction formed as a compressed part 64 whose thickness is reduced.

Further, in the seal member 61, an annular member 65 is formed integrally in an end part of an inserting side of a shield electric wire 14.

The annular member 65 is formed with a synthetic resin such as plastic and formed in the shape of L in section. In the annular member 65, an engaging protrusion 66 is formed in the inserting side of the shield electric wire 14 in an outer peripheral side thereof. Further, in a shield terminal 31, engaging protrusions 34 are not formed in an inner periphery of an annular engaging protrusion 33, but in the vicinity of a stepped part 38 in an inner periphery of a tubular part 37. The engaging protrusions 34 are engaged with the engaging protrusion 66 of the seal member 61. Thus, a movement of the seal member 61 in the axial direction is regulated.

Further, the annular member 65 includes a true circle forming part 67 in an inner peripheral side thereof. The true circle forming part 67 includes a plurality of protrusions 68 protruding inward in the diametrical direction and arranged in the circumferential direction. The protrusions 68 respectively have, in the inserting side of the shield electric wire 14, guide surfaces 68*a* gradually inclined in the inserting direction of the shield electric wire 14 inward in the diametrical direction.

Then, in the true circle forming part 67, an outer peripheral surface of an inner sheath 16 exposed from the inserted shield electric wire 14 is pushed in to a central part respectively by the guide surfaces 68*a* of the protrusions 68. Thus, even when the inner sheath 16 of the shield electric wire 14 is slightly deformed to be flat in its shape, the inner sheath 16 is inserted into the true circle forming part 67 so that the inner sheath 16 is guided to the seal member 61 under a state an outer form of the outer sheath 16 is forcedly configured to a true circle.

An inside diameter of the true circle forming part 67 is set to be slightly larger than an outside diameter of the inner sheath 16 so as not to give an influence to a smooth insertion of the inner sheath 16 of the shield electric wire 14.

As described above, according to the shield connector of the second embodiment, since the tubular seal member 61 is provided that simultaneously seals a part between the inner periphery of an insert hole 13*a* of a case 13 and the outer periphery of the inner sheath 16 forming the shield electric wire 14 and a part between the inner periphery of the shield terminal 31 and the outer periphery of the inner sheath 16 of the shield electric wire 14, a cost can be lowered by the decrease of the number of component parts. Further, an inconvenience can be eliminated that a shield performance is deteriorated.

Further, by the seal member 61, insulation between the shield terminal 31 and a crimping terminal 19 can be ensured and the shield performance can be improved.

Especially, since the inner sheath 16 forming the shield electric wire 14 is inserted into the seal member 61, even when the inner sheath 16 of the shield electric wire 14 is somewhat deformed, the outer form of the inner sheath 16 of the shield electric wire 14 can be configured to the true circle by the true circle forming part 67 of the annular member 65. Thus, the seal member 61 can be allowed to come into close contact with the inner sheath 16 of the shield electric wire 14 with a good balance to obtain a good sealing state.

The present invention is not limited to the above-described embodiments, and may be suitably modified and improved. Additionally, any of materials, forms, dimensions, numbers and arranged positions of the components in the above-described embodiments which can achieve the present invention may be arbitrarily employed without a limitation.

The present application is based on Japanese Patent Application No. 2010-196711 filed on Sep. 2, 2010, the contents of which are incorporated herein by way of reference.

INDUSTRIAL APPLICABILITY

The present invention is extremely useful in providing the shield connector may be provided which can obtain a high shield performance and a high sealing performance without enlarging the shield connector and increasing the cost.

REFERENCE SIGNS LIST

11 shield connector
13 case (objective body)
13*a* insert hole
14 shield electric wire
15 core wire
16 inner sheath
17 shield layer
18 outer sheath
21 housing
31 shield terminal
51, 61 seal member
55, 65 annular member
67 true circle forming part

The invention claimed is:

1. A shield connector, to which a shield electric wire including an inner coating, a shield layer and an outer coating provided in this order in a periphery of a core wire is connected, attached to a grounded objective body to guide the shield electric wire to an insert hole formed in the objective body, and electrically conduct the shield layer to the objective body, the shield connector comprising:

a housing, having a tubular shape so that the shield electric wire is inserted thereinto, and attached to the objective body so as to communicate with the insert hole of the objective body;

a shield terminal, having a tubular shape, being electrically conductive, attached to an inner peripheral side of the housing, and electrically conducted to the objective body and the shield layer; and a seal member, having a tubular shape, abutting an inner periphery of the insert hole and the shield electric wire, provided between the shield terminal and the shield electric wire, and configured to seal a part between the inner periphery of the insert hole and an outer periphery of the shield electric wire, and seal a part between an inner periphery of the shield terminal and the outer periphery of the shield electric wire.

2. The shield connector according to claim 1, wherein an annular member made of a resin is provided integrally in the seal member, and the annular member is engaged with the shield terminal.

3. The shield connector according to claim 2, wherein the annular member is provided in an intermediate part of the seal member in an axial direction of the seal member.

4. The shield connector according to claim 2, wherein the annular member has a true circle forming part configured to forcibly form an outer form of the inserted shield electric wire to a true circle.

* * * * *